US006101639A

United States Patent [19]

Hsu

[11] Patent Number: 6,101,639

[45] Date of Patent: Aug. 15, 2000

[54] DEVICE FOR DISPENSING TOILET BOWL CLEANING AGENT

[76] Inventor: Jin-Yang Hsu, 3F, No. 14, Ta-En Street, Hs Tun Area, Taichung, Taiwan

[21] Appl. No.: 09/172,597

[22] Filed: Oct. 15, 1998

[51] Int. Cl.[7] ..... E03D 9/03

[52] U.S. Cl. ..... 4/227.7; 4/227.6; 4/227.5; 4/227.4

[58] Field of Search ..... 4/227.1, 227.4, 4/227.5, 227.6, 227.7

[56] References Cited

U.S. PATENT DOCUMENTS

| | | | |
|---|---|---|---|
| 4,064,572 | 12/1977 | Wicks, III et al. | 4/225.1 |
| 4,261,957 | 4/1981 | Schimanski | 4/227.1 |
| 4,432,102 | 2/1984 | Woodruff et al. | 4/227.6 |
| 4,455,692 | 6/1984 | Hegge et al. | 4/227.1 |
| 5,073,993 | 12/1991 | Dewaal | 4/227.1 |
| 5,074,328 | 12/1991 | Reinders | 4/227.5 |
| 5,335,379 | 8/1994 | Waldo | 4/661 |

*Primary Examiner*—Henry J. Recla
*Assistant Examiner*—Tuan Nguyen
*Attorney, Agent, or Firm*—Browdy and Neimark

[57] ABSTRACT

A device for disolving a solid toilet bowl cleaning agent is composed of a shell body and a fastening member. The shell body is provided therein with a cell for holding the solid toilet bowl cleaning agent, and in the wall thereof with a plurality of water admitting holes in communication with the cell, and a plurality of solution discharging holes in communication with the cell. The fastening member is fastened with the shell body for locating the shell body in the water tank of a flush toilet.

8 Claims, 4 Drawing Sheets

DEVICE FOR DISPENSING TOILET BOWL CLEANING AGENT

FIELD OF THE INVENTION

The present invention relates generally to a toilet bowl cleaning agent, and more particularly to a device for dispensing the toilet bowl cleaning agent.

BACKGROUND OF THE INVENTION

The conventional devices for dispensing the toilet bowl cleaning agent are capable of discharging a certain amount of the cleaning agent into the water tank of a flush toilet after each flushing. The conventional devices are generally deficient in design in that the strength of the toilet bowl cleaning agent in the water contained in the water tank of the flush toilet is not kept constant from flush to flush. In other words, the toilet bowl cleaning agent is made denser under the circumstances that the flushing is done at brief intervals. On the other hand, the strength of the cleaning agent tends to be excessive if the flushing is done only once in a while. To sum up, the conventional devices for dispensing the toilet bowl cleaning agent are not efficient.

SUMMARY OF THE INVENTION

The primary objective of the present invention is therefore to provide an improved device for dispensing the toilet bowl cleaning agent. The device of the present invention is free from the drawbacks of the prior art device described above.

In keeping with the principle of the present invention, the foregoing objective of the present invention is attained by a dispenser consisting of a housing, and a fastening member. The housing is provided with a space for holding and dissolving a solid cleaning agent, and a plurality of water admitting holes and solution discharging holes. The solution discharging holes are located at a level lower than a level at which said water admitting holes are located. The water admitting holes and said solution discharging holes are in communication with the space for holding a solid cleaning agent.

The objective, features, functions, and advantages of the present invention will be more readily understood upon a thoughtful deliberation of the following detailed description of the present invention with reference to the accompanying drawings.

BRIEF DESCRIPTION OF THE DRAWINGS

FIG. 6 shows a sectional view of a second preferred embodiment of the present invention.

FIG. 7 shows a sectional view of a third preferred embodiment of the present invention.

DETAILED DESCRIPTION OF THE INVENTION

Figure 1:
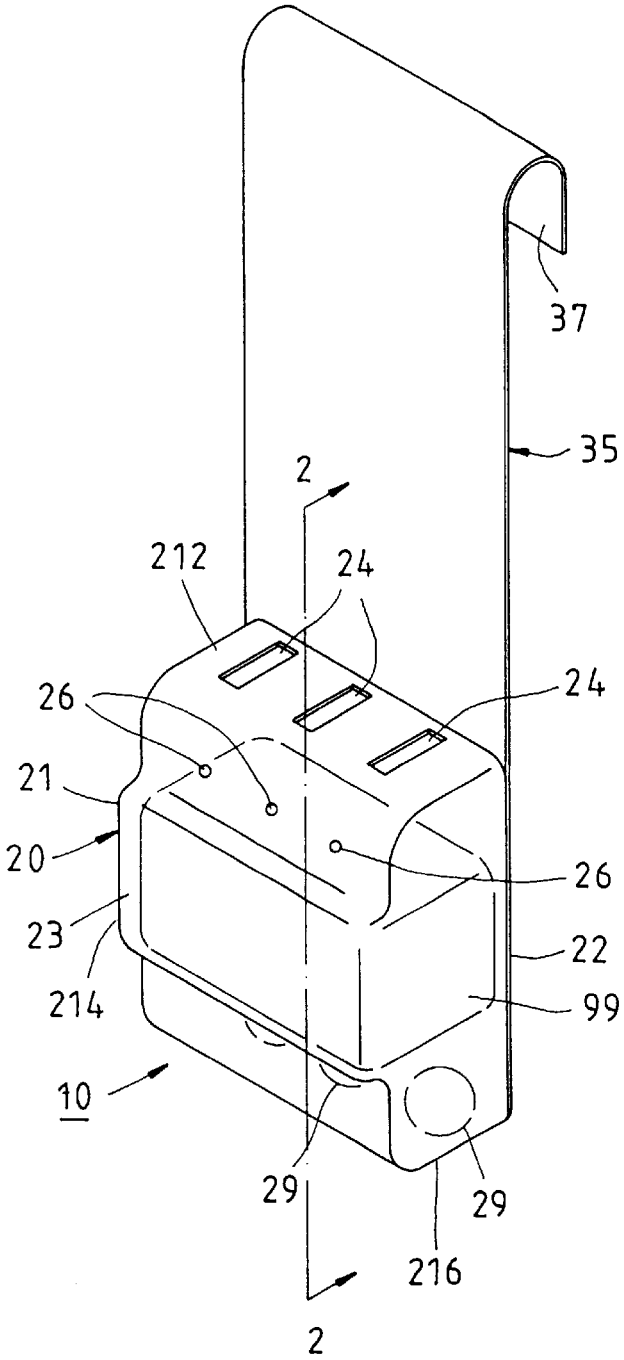
FIG. 1 shows a perspective view of a preferred embodiment of the present invention.
Figure 2:
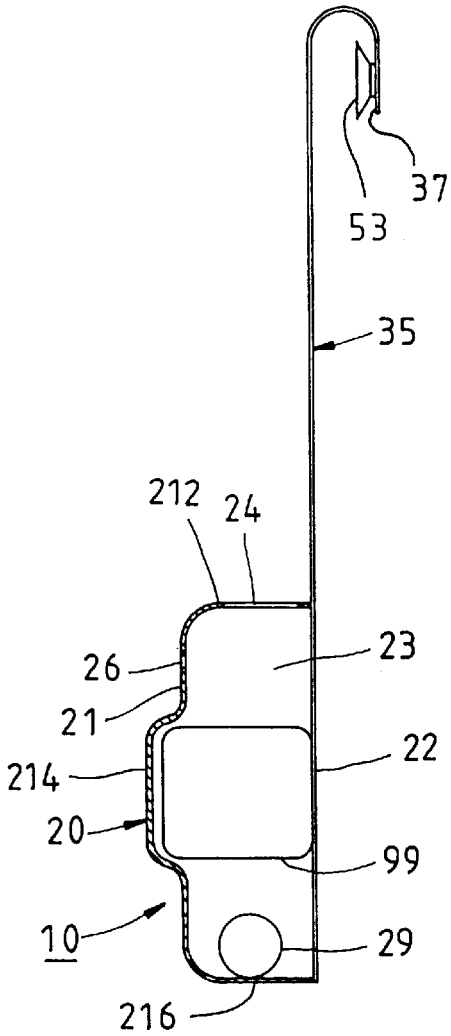
FIG. 2 shows a sectional view of a portion taken along the direction indicated by a line 2—2 as shown in FIG. 1.

As shown in FIGS. 1–2, a device 10 embodied in the present invention is intended to dispense by dissolving a toilet bowl cleaning agent and is composed of a housing 20, a plurality of sinkers 29, and a fastening member 35.

The housing 20 is formed of a shell body 21 and a sealing member 22 which is joined with the shell body 21 such that a cell 23 is formed therebetween for holding a solid bar 99 of toilet bowl cleaning agent. The shell body 21 has an upper wall 212 a front wall 214 and a bottom wall 216. The upper wall 212 is provided with a plurality of water-admitting holes 24. A plurality of solution discharging holes 26 are located at the top portion of the front wall 214 and are smaller in area than the water admitting holes 24.

The sinkers 29 of the preferred embodiment of the present invention are glass balls, which are disposed at the bottom of the cell 23 to cause the device 10 to submerge in the water tank of the flush toilet.

The fastening member 35 is made integrally with the back wall sealing member 22 and is provided with a locating portion 37 capable of being retained by the wall edge of the water tank of the flush toilet. The locating portion 37 can be further secured to the tank wall edge by a piece of adhesive paper.

Figure 3:
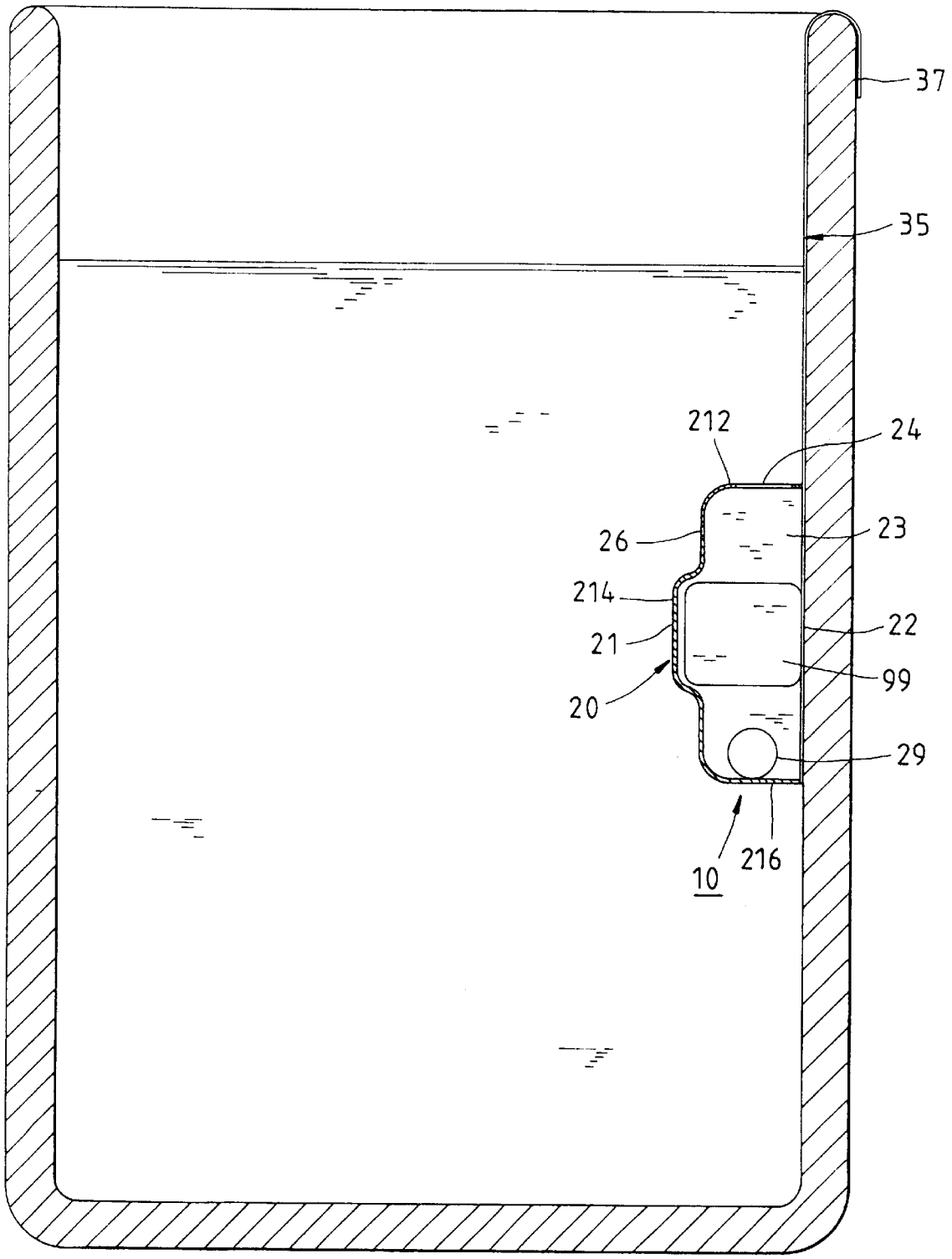
FIG. 3 is a schematic view showing the use of the present invention which is held in a toilet water tank full of water.
Figure 4:
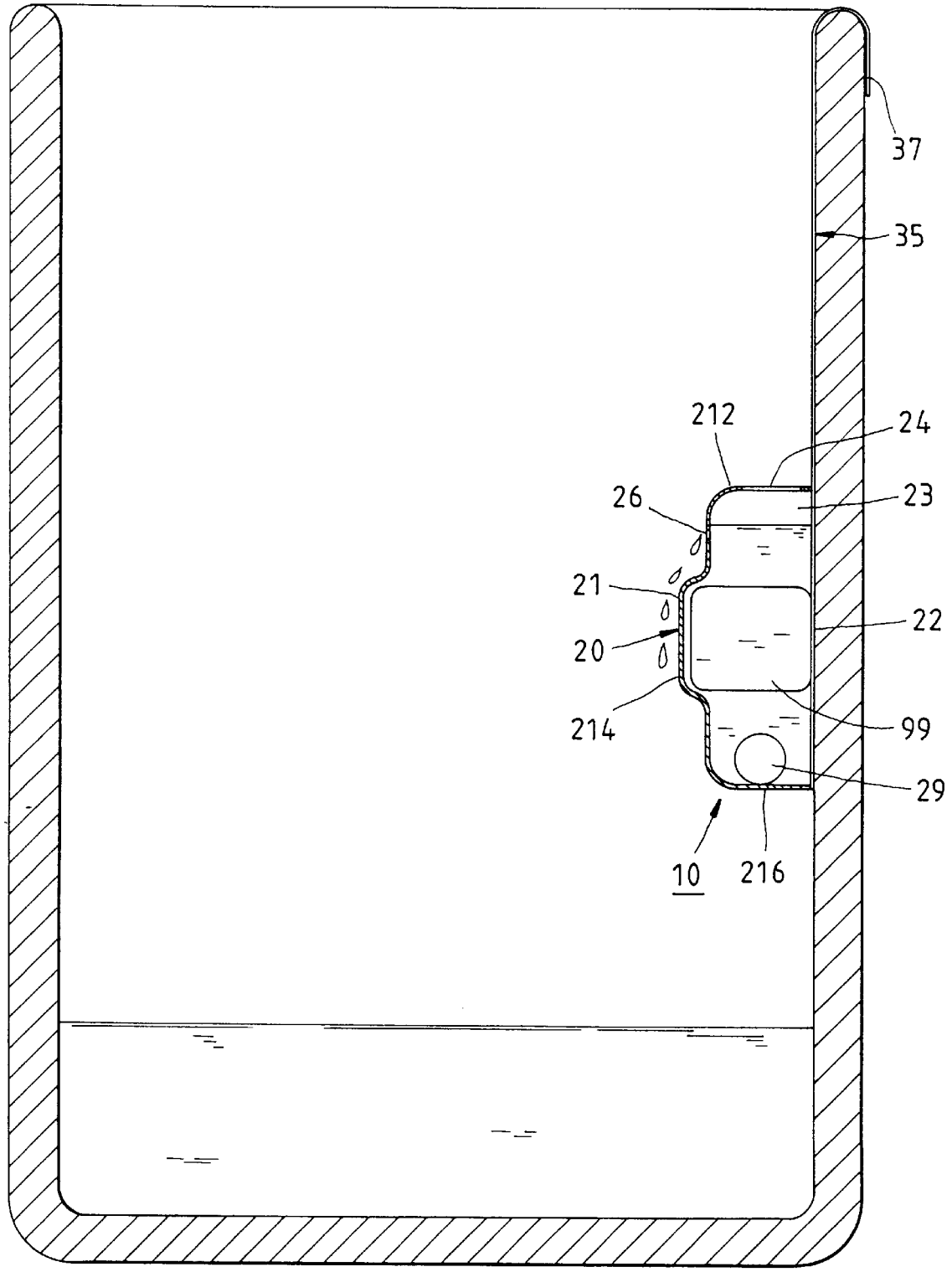
FIG. 4 is another schematic view showing the use of the present invention which is held in the toilet water tank empty of water.

As illustrated in FIG. 3, the device 10 is located in a flush toilet water tank full of water such that the housing 20 is submerged in the water, and that the water of the water tank enters the cell 23 via the holes 24 and 26, thereby resulting in the formation of a solution containing water and the toilet bowl cleaning agent of a predetermined strength. The solution is kept in the cell 23. However, as the toilet is flushed, the water level in the water tank is lowered. When the water level is lower than the water admitting holes 24, the solution kept in the cell 23 is let out via the solution discharging holes 26. In view of the fact that the solution discharging holes 26 are small in size, the solution kept in the cell 23 is discharged slowly. As soon as the water tank has become empty of water, the water tank is quickly replenished with water. As a result, the solution is once again kept in the cell 23. This implies that only a predetermined amount of the solution is discharged into the water tank via the solution discharging holes 26 at the outset of the flushing until the completion of the replenishing of the water tank with water. As the replenishing of the water tank with water takes longer time to complete, as compared with the flushing time, the solution contained in the cell 23 is capable of flowing into the water tank before the level of the replenished water reaches the level at which the solution discharging holes 26 are located. In the meantime, the most (about 80%) of the solution remains in the cell 23. As the level of the rising water in the water tank is higher than the level at which the solution discharging holes 26 are located, the water begins flowing back into the cell 23 via the solution discharging holes 26. As the level of the rising water is higher than the level at which the water admitting holes 24 are located, the water begins flowing into cell 23 via the water admitting holes 24. The water is than mixed with the residual solution kept in the cell 23, thereby a new solution is formed in the cell 23. The new solution contains the toilet bowl cleaning agent of a strength which is close to the predetermined strength. Even if the toilet is flushed at brief intervals, the water of each flush always contains the solution of a strength that is corresponding to the predetermined strength.

Figure 5:
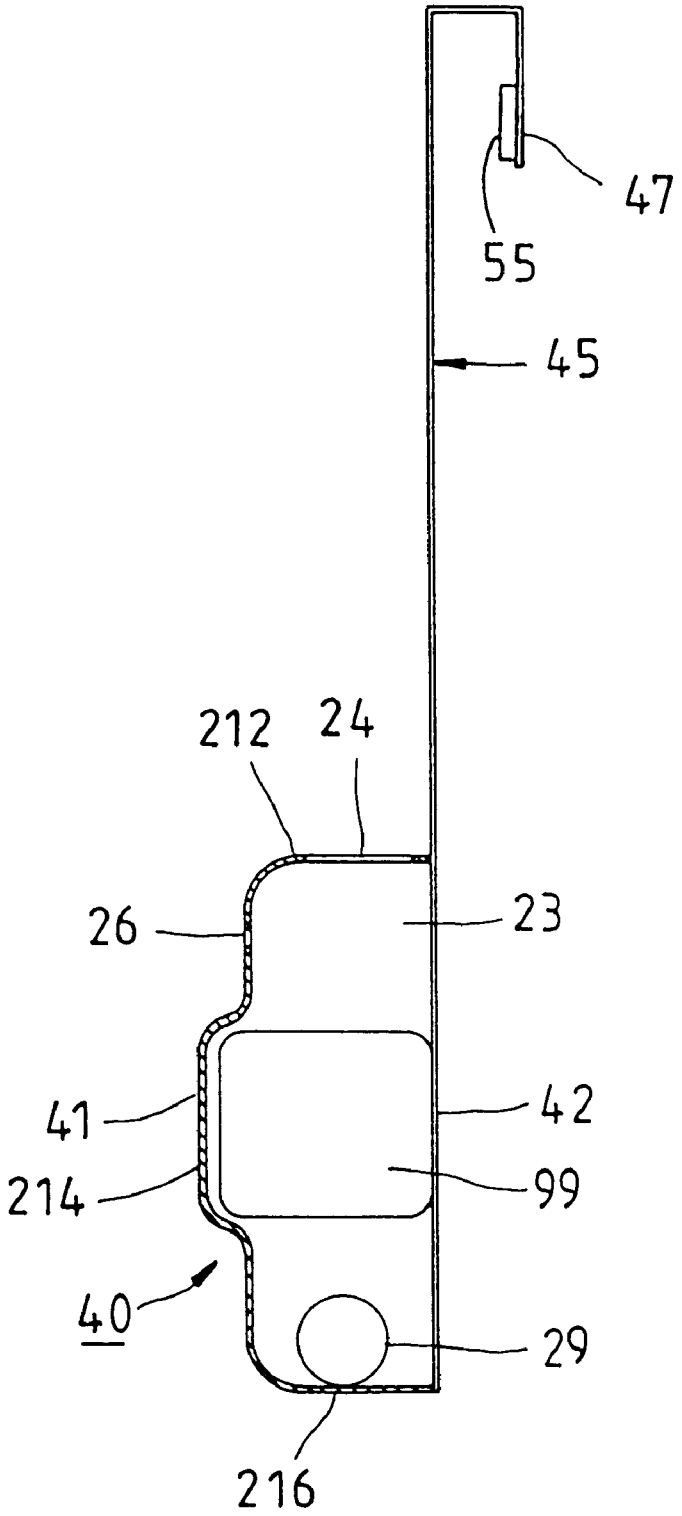
FIG. 5 shows a sectional view of a first preferred embodiment of the present invention.

As shown in FIG. 5, a device 40 of another preferred embodiment of the present invention is basically similar in construction to the device 10 of the first preferred embodiment of the present invention, except that the former is composed of a sealing member 42 of a rigid plate. The sealing member 22 of the device 10 is made of a soft plastic material. The device 40 is further composed of a shell body 41 and a fastening member 45 which is made integrally with the sealing member 42 and is provided with a locating portion 47 for securing the device 40 in place.

The water admitting holes 24 and the solution discharging holes 26 may be located in the sealing member 22 other than the shell body 21, or combination of both in the shell body 21 and the discharge hole 26" located in the sealing member 35. The arrangement of FIG. 6 can be reversed combination of both is in the sealing member and discharge hole 26'" is in the shell body. However, the water admitting holes 24 must be located at a level higher than the level at which the solution discharging holes 26 are located.

The locating portion 37 or 47 may be provided with a suction disk or adhesive tape for enhancing the attachment of the locating portion 37 or 47 to the wall of the water tank of a flush toilet. The fastening member 35 or 45 of the present invention may be made integrally with the shell body 21 or 41.

The present invention may be devoid of the sinkers 29 under the circumstances that the specific gravity of the housing 20 is greater than that of water.

The cell 23 of the present invention may be provided with an aromatizing agent, which is kept in the cell 23 along with the solution and is discharged into the water tank along with the solution.

What is claimed is:

1. A device for dissolving a solid toilet bowl cleaning agent into a water tank of a flush toilet, said device comprising:

a housing provided therein with a cell for holding the solid toilet bowl cleaning agent;

said cell being spaced apart from a bottom wall of said housing;

said housing being provided with a plurality of water admitting holes, and a plurality of solution discharging holes located, said water admitting holes and said solution discharging holes being located above said cell and said bottom wall, said water admitting holes and said solution discharging holes being in communication with said cell of said housing;

wherein said plurality of solution discharging holes are located at a level lower than a level at which said water admitting holes are located; and a fastening member fastened with said housing for locating said housing below water in the water tank of the flush toilet prior to flushing.

2. The device as defined in claim 1, wherein said housing is formed of a shell body and a sealing member which is joined with said shell body such that said cell is formed therebetween, said water admitting holes and solution discharging holes being located in said shell body.

3. The device as defined in claim 1, wherein said cell of said housing is provided with a plurality of sinkers located at a bottom of said cell.

4. The device as defined in claim 3, wherein said sinkers are glass balls.

5. The device as defined in claim 1, wherein said fastening member is provided with a locating portion capable of being retained by a wall edge of the water tank of the flush toilet.

6. The device as defined in claim 5, wherein said locating portion is provided with a suction disk.

7. The device as defined in claim 5, wherein said locating portion is provided with an adhesive tape.

8. The device as defined in claim 1, wherein said water admitting holes are greater in diameter than said solution discharging holes.

* * * * *